United States Patent [19]

McNally et al.

[11] Patent Number: 4,759,297

[45] Date of Patent: Jul. 26, 1988

[54] FURNACE BURNER BLOCK

[75] Inventors: Thomas A. McNally, Downingtown, Pa.; Susan E. Strzelec, Worcester, Mass.

[73] Assignee: Norton Company, Worcester, Mass.

[21] Appl. No.: 90,074

[22] Filed: Aug. 27, 1987

[51] Int. Cl.[4] ..... F23L 5/00

[52] U.S. Cl. ..... 110/182.5; 110/336; 266/270

[58] Field of Search ..... 110/182.5, 338, 336; 266/270, 282, 283

[56] References Cited

U.S. PATENT DOCUMENTS

| | | | |
|---|---|---|---|
| 3,043,578 | 7/1962 | Cohn | 122/6.6 X |
| 4,437,415 | 3/1984 | Spielman | 110/182.5 |
| 4,572,487 | 2/1986 | Slagley | 266/270 |
| 4,632,367 | 12/1986 | LaBate | 266/270 X |

OTHER PUBLICATIONS

P. Boch, "Thermal Shock Properties of Ceramics", in *Fracture of Non-Metallic Materials* (1987), pp. 117-135.

*Primary Examiner*—Edward G. Favors
*Attorney, Agent, or Firm*—Norvell E. Wisdom, Jr.

[57] ABSTRACT

The burner block or tile in industrial furnaces is conventionally made of refractory ceramic material. Such refractories are susceptible to cracking from thermal shock if the temperature of the burner block fluctuates during use. The life of the burner block can be greatly improved by making it in two parts: a cavity bounding inner part made from a material more shock resistant than a conventional refractory and a conventional refractory outer part. Best results are obtained with a thin inner liner of recrystallized silicon carbide having a thermal conductivity of over 18 W/(m K) and a modulus of rupture of at least 120 MPa.

20 Claims, 1 Drawing Sheet

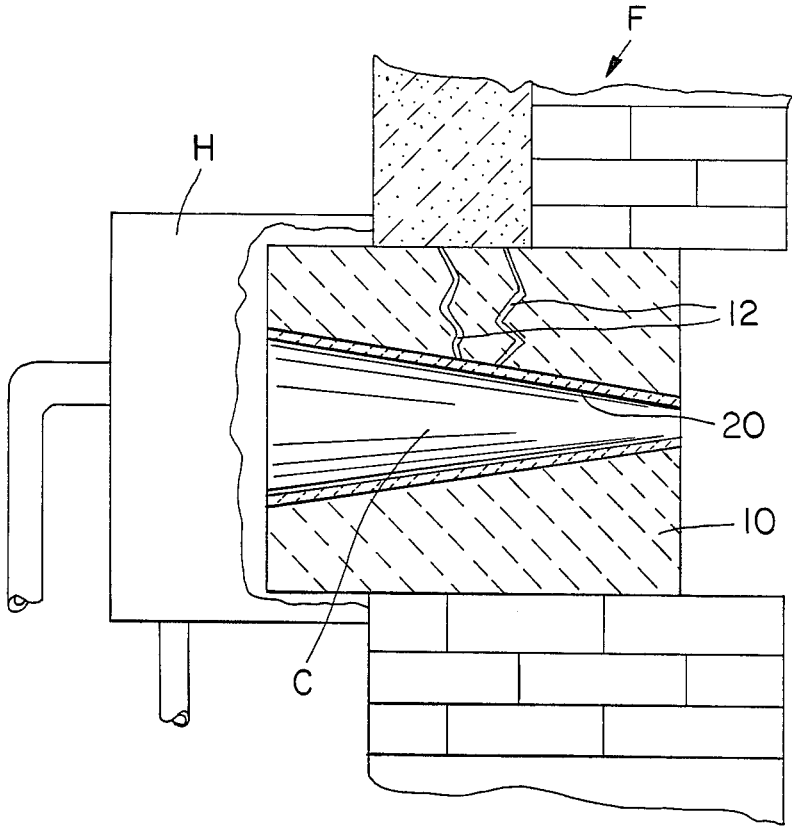
F
H
12
20
10
C

FURNACE BURNER BLOCK

TECHNICAL FIELD

This invention relates to structures known as "burner blocks" or "burner tiles" that are commonly used in high temperature industrial furnaces, particularly high velocity burners used for such application as firing ceramics, melting glass and metals, burning trash, etc. The burner block contains a cavity extending through the block, and fuel and oxidant usually are supplied at one end of this cavity while products of combustion pass out at the other end. The shape of the cavity often is important in controlling the efficiency of combustion. In many applications it is also important to separate the combustion space from other nearby materials, in order to prevent contamination of these materials or of the products of combustion itself, and to insulate other parts of the furnace and its accessories from the heat of the combustion chamber.

TECHNICAL BACKGROUND

In the prior art, burner blocks have commonly been made of refractory ceramics. This is a type of ceramic which has a long-standing use in the art for providing insulation, and as such is often used to form the wall of large furnaces or other structures. For the purposes of this invention, refractory materials are defined as materials having a melting point of at least 500 C. and a thermal conductivity of not more than 5 watts per meter per degree Kelvin (hereinafter abbreviated as W/(m K) at at least one temperature in the range from 15–1500 C. If there is a temperature within the range from 15–1500 C. at which a refractory has a modulus of rupture of not more than 30 megapascals (MPa), it is further designated herein as a "weak" refractory.

Although refractories are good insulators against heat, they do not usually have good resistance to thermal shock from rapid changes in temperature. Weak refractories have even less resistance to thermal shock than stronger ones. Resistance to thermal shock is a very complex phenomenon, which has been recently reviewed by P. Boch, "Thermal Shock Properties of Ceramics", *Fracture of Non-Metallic Materials* (1987). As described in this reference and the work reviewed in it, at least two different major theories and four different thermal shock parameters have been proposed for characterizing materials, and a wide variety of specific geometries have been theoretically studied. Resort to experiment is still necessary to determine adequate thermal shock resistance in most practical case, however.

If a burner block has insufficient thermal shock resistance for its service conditions, it will crack, often quite soon after being put into service. Once the block has cracked, it may fail to provide effective separation of the combustion zone from other spaces, proper definition of the shape of the combustion zone, and/or adequate insulation of the environment from the heat developed in a functioning combustion zone. Furthermore, any crack induces additional sources of mechanical stress, so that once initiated, cracking usually rapidly worsens if a cracked burner block is kept in service.

SUMMARY OF THE INVENTION

It has now been found that the disadvantages of the prior art can be overcome by using a burner block that combines a conventional refractory outer portion with a cavity bounding portion made from a material having a thermal conductivity of at least 7 W/(m K) within the range of service temperatures of the burner block, including room temperature. Still higher thermal conductivity for this material is preferable. Such a material is arbitrarily designated hereinafter as a "practically thermal shock resistant" or "PTSR" material. By using a body of a PTSR material to form the wall of the cavity in the burner block, much longer life of the burner block is achieved. The cavity can preferably be defined by a thin liner of the PTSR material, so that the insulating quality needed in the burner block as a whole can be adequately provided by the refractory material outside the liner without changing the overall dimensions of a conventional burner block.

It is also advantageous if the PTSR material that defines the burner block cavity has a modulus of rupture of at least 50 MPa within the service temperature range of the combustion cavity. A PTSR material with at least this level of modulus of rupture is designated herein as "strong."

BRIEF DESCRIPTION OF THE DRAWING

The only drawing FIGURE shows a cross sectional view of an example burner block according to this invention, along with some of the other parts of a furnace in which such a burner block might be used.

DESCRIPTION OF THE PREFERRED EMBODIMENTS

The generally most preferred material for making at least the inner wall of burner blocks according to this invention is a type of polycrystalline silicon carbide material available under the designation CRYSTAR TM CS101 from Norton Company, Worcester, Mass. This is a recrystallized silicon carbide material with a thermal conductivity of 19 W/(m K) at 1600 C. and a modulus of rupture of 120–150 MPa at 1500 C. Another suitable material is a similar type of silicon carbide that has been impregnated with silicon metal. Such a product is available from Norton Co. under the designation CRYSTAR TM CS 101k. This product is more resistant to oxidation than CS101 and therefore might be preferred for combustion liners to be used in highly oxidizing or corrosive atmospheres. It is more expensive than CS101, however, and is not suitable for use above 1410 C., the melting point of silicon. Still another suitable type of polycrystalline silicon carbide, one bonded by a silicon nitride intergranular phase, is available from Norton Co. under the designation CN236. This form of silicon carbide has a thermal conductivity of 14 W/(m K) at 1149 C. and a modulus of rupture of 55 MPa at 1500 C. Thus it is not quite as thermally shock resistant as CS101 or 101K, but it is considerably less expensive and is adequate for some applications. Silicon nitride and aluminum nitride are also effective PTSR materials, but are generally more expensive than silicon carbide.

A preferred type of structure in which a PTSR material could be used for this invention is shown in the only drawing FIGURE, in which F represents a furnace having a burner housing H in one part of its wall. This burner housing H contains supply conduits for the fuel required for the combustion to be maintained in the burner block cavity C. The housing may also contain conventional controls, insulation, and other items. The cavity C is a hollow space bounded by a liner 20 made of a PTSR material. The remainder of the burner block is made of refractory ceramic material 10.

One use of this invention is to repair cracked conventional burner blocks. The drawing FIGURE shows cracks 12. If such cracks appear in a conventional type of burner block in which the inner wall is made of refractory, the block can be repaired by removing an amount of the refractory corresponding to the thickness of the liner, then inserting a liner of a PTSR material.

Probably the most advantageous use of this invention, however, is to form long lasting new burner block assemblies. For this use, it is advantageous to cast the refractory part of the assembly around the liner. Conventional burner blocks without a liner are often cast around an arbor which is later removed. A liner of a PTSR material as required for this invention can be used instead of the usual arbor, thereby achieving a strongly bonded burner block assembly according to this invention. When this method of preparing the burner block is used, the method of casting refractory around the liner involves dispersing particles of the refractory material in a liquid, and the PTSR material to be used for the liner, like the preferred CRYSTAR TM CS101 material, is not impervious to liquids, it is advantageous to provide a liquid-impervious glaze over the outer surface of the liner before beginning the casting, in order to prevent penetration into the liner by part of the slurry from which the refractory part of the burner block is cast.

The liner for use according to this invention may be made by any conventional ceramic forming technique. For the preferred CRYSTAR TM CS101 PTSR material, slip casting is the preferred forming technique.

The liner for use in this invention is preferably kept fairly thin, as this will improve its thermal shock resistance no matter what material it is made of. Specifically, it is preferred that the liner should be no more than 7 mm thick. The only lower limit on its thickness is that required for the mechanical strength needed to survive its manufacture and use.

What is claimed is:

1. In a process comprising maintaining combustion within a furnace containing a burner block having a cavity extending therethrough, said process including variations from time to time in the temperature of said burner block, the improvement wherein the part of said burner block defining the wall of said cavity is composed of a practically thermal shock resistant (PTSR) ceramic material and the outer part of said burner block is made of a refractory material.

2. A process according to claim 1, wherein said PTSR material is a strong material and has a thermal conductivity of at least 12 W/(m K).

3. A process according to claim 2, wherein said PTSR material is predominantly silicon carbide.

4. A process according to claim 3, wherein said PTSR material is predominantly a recrystallized polycrystalline silicon carbide and has a thermal conductivity of at least 18 W/(m K).

5. A process according to claim 4, wherein said wall of said cavity is formed by a liner having a thickness not greater than 7 mm.

6. A process according to claim 3, wherein said wall of said cavity is formed by a liner having a thickness not greater than 7 mm.

7. A process according to claim 2, wherein said wall of said cavity is formed by a liner having a thickness not greater than 7 mm.

8. A process according to claim 1, wherein said wall of said cavity is formed by a liner having a thickness not greater than 7 mm.

9. A burner block having a cavity extending therethrough and comprising (a) a practically thermal shock resistant (PTSR) ceramic material lining the hollow thereof and (b) a refractory material surrounding said PTSR material.

10. A burner block according to claim 9, wherein said PTSR material is a strong material and has a thermal conductivity of at least 12 W/(m K).

11. A burner block according to claim 10, wherein said PTSR material is predominantly silicon carbide.

12. A burner block according to claim 11, wherein said PTSR material is predominantly a recrystallized polycrystalline silicon carbide and has a thermal conductivity of at least 18 W/(m K).

13. A burner block according to claim 12, wherein said PTSR material is in the form of a liner having a thickness not greater than 7 mm.

14. A burner block according to claim 11, wherein said PTSR material is in the form of a liner having a thickness not greater than 7 mm.

15. A burner block according to claim 10, wherein said PTSR material is in the form of a liner having a thickness not greater than 7 mm.

16. A burner block according to claim 9, wherein said PTSR material is in the form of a liner having a thickness not greater than 7 mm.

17. A process for making a burner block, comprising the steps of:

(a) forming a liner out of a practically thermal shock resistant (PTSR) ceramic material;

(b) forming around the outside of said liner an insulating body of a refractory material; and (c) consolidating said insulating body and bonding it to said liner.

18. A process according to claim 17, wherein said PTSR material is predominantly a recrystallized polycrystalline silicon carbide and has a thermal conductivity of at least 18 W/(m K).

19. A process according to claim 18, wherein said liner is not more than 7 mm thick.

20. A process according to claim 17, wherein said liner is not more than 7 mm thick.

* * * * *